US010316561B2

(12) United States Patent
Barker

(10) Patent No.: US 10,316,561 B2
(45) Date of Patent: Jun. 11, 2019

(54) PLAYLESS HINGE SYSTEM WITH RELEASABLE HINGE PIN

(71) Applicant: Jeremy Barker, Morgan, UT (US)

(72) Inventor: Jeremy Barker, Morgan, UT (US)

( * ) Notice: Subject to any disclaimer, the term of this patent is extended or adjusted under 35 U.S.C. 154(b) by 0 days.

(21) Appl. No.: 15/623,170

(22) Filed: Jun. 14, 2017

(65) Prior Publication Data

US 2018/0363342 A1 Dec. 20, 2018

(51) Int. Cl.

| | |
|---|---|
| ***E05D 7/10*** | (2006.01) |
| ***E05D 5/12*** | (2006.01) |
| ***E05D 5/04*** | (2006.01) |
| *E05D 3/02* | (2006.01) |
| *E05D 5/10* | (2006.01) |

(52) U.S. Cl.

CPC ..... *E05D 7/1022* (2013.01); *E05D 5/04* (2013.01); *E05D 5/12* (2013.01); *E05D 7/1016* (2013.01); *A47B 2220/0072* (2013.01); *E05D 3/02* (2013.01); *E05D 2005/108* (2013.01); *E05Y 2900/20* (2013.01)

(58) Field of Classification Search

CPC ..... Y10T 16/53607; Y10T 16/5361; Y10T 16/557; E05D 7/1022; E05D 7/1005; E05D 7/1027; E05D 7/1055; E05D 7/123; E05D 3/02; E05D 5/02; E05D 5/12; E05D 5/128; E05D 2005/108; A47B 2220/0072

See application file for complete search history.

(56) References Cited

U.S. PATENT DOCUMENTS

| | | | | | |
|---|---|---|---|---|---|
| 737,360 | A * | 8/1903 | Daly | E05D 7/1016 | 16/381 |
| 2,990,570 | A * | 7/1961 | Gilpatrick | E05D 7/12 | 16/257 |
| 3,141,190 | A * | 7/1964 | Reiss | E05D 7/1044 | 16/259 |
| 3,188,686 | A * | 6/1965 | Orcutt | E05D 5/128 | 16/263 |
| 3,593,365 | A * | 7/1971 | Amundsen | G02C 5/2209 | 16/228 |
| 3,596,554 | A * | 8/1971 | Low | F16B 21/165 | 24/453 |
| 3,675,271 | A * | 7/1972 | Fellwock | E05D 7/02 | 16/265 |
| 3,766,599 | A * | 10/1973 | Ullman, Jr. | E05D 7/1022 | 16/257 |

(Continued)

*Primary Examiner* — Chuck Y Mah

(74) *Attorney, Agent, or Firm* — Steven Rinehart

(57) ABSTRACT

A hinge assembly suppressing periodic motions and abrasive wear that supports an axial load and integrated a releasable hinge pin with retractable latch pins. The connector arms for the hinge assembly may include bearings, smooth outer surfaces, and tight fittings to help suppress the periodic motions and abrasive wear. Adjustable mounting apertures reduce stress on the hinge system. A hinge aperture for each member enables an axial load arm, such as thrust bearings, to pass through for reducing periodic movements during pivotal operation. A lock arm can also pass through the hinge apertures. The lock arm uses a locking pin to fasten the members together. A smooth outer surface inhibits abrasive wear and creates a smooth pivoting motion. Non-circular mounting apertures may enable adjustable mounting for reducing stress on the system.

6 Claims, 8 Drawing Sheets

(56) References Cited

U.S. PATENT DOCUMENTS

| | | | | | |
|---|---|---|---|---|---|
| 3,852,943 | A * | 12/1974 | Healy | A62B 1/14 | 16/257 |
| 4,070,728 | A * | 1/1978 | Herman | E05D 7/0415 | 16/243 |
| 4,340,991 | A * | 7/1982 | Gidseg | E05D 5/046 | 16/254 |
| 5,008,975 | A * | 4/1991 | Wang | E05D 7/10 | 16/254 |
| 5,040,268 | A * | 8/1991 | Knurr | E05D 5/10 | 16/261 |
| 5,199,733 | A * | 4/1993 | DeLorme | B60D 1/02 | 24/453 |
| D396,402 | S * | 7/1998 | Rastovski | F16B 21/165 | D8/354 |
| 6,386,789 | B1 * | 5/2002 | Chausse | F16B 21/165 | 403/322.2 |
| 6,893,184 | B2 * | 5/2005 | Mills | F16B 19/109 | 24/607 |
| 8,162,581 | B2 * | 4/2012 | Soltis | B23B 31/1071 | 411/347 |
| 8,584,318 | B1 * | 11/2013 | Tu | E05D 7/1016 | 16/262 |
| 9,297,401 | B2 * | 3/2016 | Langlais | F16B 21/165 | |
| 2014/0359921 | A1 * | 12/2014 | Ide | A42B 3/20 | 2/424 |

* cited by examiner

First Hinge Assembly 102

PLAYLESS HINGE SYSTEM WITH RELEASABLE HINGE PIN

FIELD OF THE INVENTION

This invention relates to hinges and more particularly relates to hinges that reduce play, periodic motion and abrasive and rotational abrasion on a hinge with bearings and pins having a smooth outer surface.

BACKGROUND

Description of the Related Art

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Hinges are well-known in the art and operable to support a door for opening and closing in a pivoting motion. Broadly speaking, the hinge is a type of bearing that connects two solid objects, allowing only a limited angle of rotation between them. Two objects connected by an ideal hinge rotate relative to each other about a fixed axis of rotation.

In many instances, there are various types of hinges used to connect a door separating two rooms, or the open part of a piece of furniture, with the respective jamb in such a way that the door or open furniture part can rotate about an ideal axis of rotation to provide access to the space on the other side of the door.

Often, hinges comprise two fastening members. One of the members can be recessed in the door or open furniture part, for example in the outer edge of it, and the other member can be recessed in the jamb. The members are joined to each other by a connecting device, such as arms which are articulated to varying degrees, which allows them to move relative to each other between two limit positions corresponding to the open and closed positions of the door or open furniture part.

An axial load is a force administered along the lines of an axis. It is also commonly used to describe a specific strength of materials known as their uniaxial compressive or tensile strength and also to find the variation of their strength with increasing confining pressure. A bookcase can have heavy doors and books that place a heavy axial force on the hinges.

Often, the axial load can cause a hinge to sag and deform after a duration. If the load is heavy enough, such as in a bookcase door carrying books, the hinges may deteriorate, forming spaces between the pivoting members. This extra space can cause vibrations and abrasive wear on the hinge components.

In view of the foregoing, it is clear that these traditional hinges having weak structural integrity and threaded outer surfaces as connecting arms are not perfect and leave room for more optimal approaches to dampening the periodic motions and abrasive wear in the hinge, especially the bookcase hinge.

SUMMARY

From the foregoing discussion, it should be apparent that a need exists for a dampening hinge system that suppresses periodic motions and abrasive wear on a hinge supporting an axial load. The present invention applies various components in novel ways to achieve this. In some embodiments, the connector arms for the hinge system may include bearings, smooth outer surfaces, and tight fittings to help suppress the periodic motions and abrasive wear. Additionally, adjustable mounting apertures provide flexibility during mounting, which reduces stress on the hinge system.

The present invention has been developed in response to the present state of the art, and in particular, in response to the problems and needs in the art that have not yet been fully solved by currently available apparatus. Accordingly, the present invention provides: a hinge for reducing a periodic motion while supporting an axial load, the hinge comprising: a first hinge member configured to at least partially support an axial load, and rotatable to move a door between an open position and a closed position, the first hinge member comprising a first jamb member disposed to attach to one of a door and a jamb, the first jamb member defining a first jamb hinge aperture, the first jamb member further defining a plurality of first jamb mounting apertures configured to enable passage of at least one fastener for fastening the first hinge assembly to one of the jamb and the door, wherein at least one of the first jamb mounting apertures having a noncircular cross section for enabling adjustable mounting of the first hinge member, wherein a periodic motion is at least partially reduced by the adjustable mounting, a second hinge member configured to cooperate with the first hinge member and having a common longitudinal axis so that the first and second hinge members are rotatable to move the door between the open position and the closed position, wherein the second hinge member comprises a second jamb member disposed to attach to one of a door and the jamb, the second hinge member defining a second jamb hinge aperture, the second jamb hinge aperture comprising a jamb slot adapted to enable passage of a releasable hinge pin for fastening the second hinge member to the first hinge member, wherein first hinge member and second hinge member are adapted to enable passage of the releasable hinge pin, the releasable hinge pin comprising: a depressible, spring-loaded button protruding upwardly from a proximal top end of the hinge pin, the depressible, spring-loaded button adapted to retract two latch pins protruding laterally from a cylindrical body of the hinge pin.

The door and the jamb may be configured for a bookcase. The axial force may comprise a weight of the bookcase and at least one item in the bookcase. The periodic motion may comprise excessive spacing and vibrations between the first hinge member and the second hinge member.

The noncircular cross section may enables a vertical adjustment during mounting. The axial load arm may be configured to support up to a three hundred pound load.

A second hinge for reducing a periodic motion while supporting an axial load is also provided, the hinge system comprising: a first jamb member defining a first jamb hinge aperture, the first jamb hinge adapted to enable passage of a releasable hinge pin; a second jamb member defining a second jamb hinge aperture, the second jamb hinge adapted to enable passage of a releasable hinge pin; a releasable hinge pin, the releasable hinge pin comprising: a depressible, spring-loaded button protruding upwardly from a proximal top end of the hinge pin, the depressible, spring-loaded button adapted to retract two latch pins into a cylindrical body of the hinge pin; wherein the hinge is configured to at least partially support an axial load, and rotatable to move a door between an open position and a closed position.

A third hinge for reducing a periodic motion while supporting an axial load is also provided, the hinge system comprising: a first jamb member defining a first jamb hinge aperture, the first jamb hinge adapted to enable passage of a releasable hinge pin; a second jamb member defining a second jamb hinge aperture, the second jamb hinge adapted to enable passage of a releasable hinge pin; a releasable hinge pin, the releasable hinge pin comprising: a depressible, spring-loaded button protruding upwardly from a proximal top end of the hinge pin, the depressible, spring-loaded button adapted to retract two latch pins into a cylindrical body of the hinge pin; wherein the hinge is configured to at least partially support an axial load, and rotatable to move a door between an open position and a closed position.

One objective of the present invention is to at least partially eliminate periodic motion, vibration, and excessive space between the members of the first and second hinge assemblies. The tighter, load distributing bearing provides a pivoting motion that also minimizes sagging by the door and potential maintenance problems.

Another objective is to provide a cost effective hinge system for bookcases, Murphy Doors™, and invisible doors. These types of doors may carry a heavy axial load and operate to pivot at a slow rotational speed.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which:

FIG. 1A is a top view of an exemplary first jamb member, FIG. 1B is a detailed perspective view of an exemplary first jamb member, FIG. 1C is a top view of an exemplary first door member, and FIG. 1D is a detailed perspective view of an exemplary first door member, in accordance with the present invention;

FIG. 1E is a top side view of an exemplary first jamb member and FIG. 1F is a detailed top perspective view of the second embodiment of the exemplary first door member, in accordance with the present invention;

FIG. 2A is a top view of an exemplary second jamb member, FIG. 2B is a detailed perspective view of an exemplary second jamb member, FIG. 2C is a top view of an exemplary second door member, and FIG. 2D is a detailed perspective view of an exemplary second door member, in accordance with the present invention; FIG. 2E is a top side view of the exemplary second jamb member and FIG. 2F is a detailed top perspective view of the second embodiment of the exemplary second door member, in accordance with the present invention;

FIG. 3A is a top view of an exemplary second jamb member having a protruding portion moving between a lock position and a release position, FIG. 3B is a detailed perspective view of an exemplary second door member, and FIG. 3C is a detailed perspective view of an exemplary lock arm, in accordance with the present invention;

DETAILED DESCRIPTION

Figure 1A:
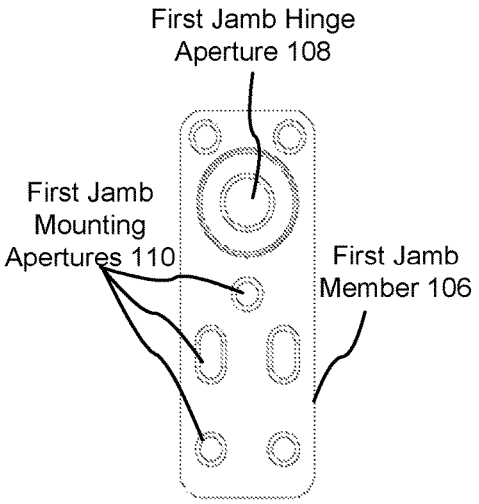
FIGS. 1A, 1B, 1C, and 1D are various views illustrating an exemplary first hinge assembly, where

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided, such as examples of programming, software modules, user selections, network transactions, database queries, database structures, hardware modules, hardware circuits, hardware chips, etc., to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

The flow chart diagrams included herein are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

FIGS. 1A to 3C illustrate various views of an exemplary hinge system 100 with novel components, configurations, and operational positions. In one embodiment of the present invention, a hinge system 100 helps suppress periodic motions and rotational abrasion on a hinged door and jamb. The hinge system 100 may include a bookcase hinge supporting an axial load. The axial load may include the weight from gravity, a door, a bookcase, and any item in the bookcase. The hinge system 100 may serve to support the axial load and dampen or reduce the periodic motions while the door pivots between an open position and a closed position. Increasing the structural capacity and efficiency of the load bearing pivot mechanisms enables the hinge system 100 to perform the reducing functions.

The hinge system 100 includes a first and second hinge assembly 102, 200 that cooperate along a common longitudinal axis of a door, and position at different elevations on a jamb. The first hinge assembly 102 utilizes an axial load arm 104 having a bearing to dampen the periodic motions and inhibit sagging on the door. A second hinge assembly 200 uses a lock arm 300 having a substantially smooth outer surface to inhibit abrasive wear while pivoting. The lock arm 300 may also have sufficient structural integrity as to help reduce the play or the periodic motions. Each hinge assembly 102, 200 may be adjusted during mounting to the jamb and the door. The capacity to adjust the alignment and orientation of the assemblies 102, 200 during mounting helps reduce stress on the hinge system 100, and also aligns the members 102, 200 more accurately for enhancing the dampening effect. In this manner, the door may pivot between an open position and a closed position in a smooth, tight pivoting motion, with minimal damage to the hinge system 100. Suitable materials for the hinge system 100 may include, without limitation, brass, aluminum, steel, iron, metal alloy, wood, and a rigid polymer.

As referenced in FIGS. 1A, 1B, 1C and 1D, the hinge system 100 comprises a first hinge assembly 102. The first hinge assembly 102 forms one of the two hinge assemblies 102, 200 that make up the hinge system 100. The first hinge assembly 102 includes a first jamb member 106 and a first door member 112 that pivotally join through an axial load arm 104. The first jamb member 106 and the first door member 112 may be similar, comprising substantially planar brackets having differently sized and positioned apertures for receiving the axial load arm 104, and for mounting to the jamb or door. In essence, the first hinge assembly 102 comprises two members, or brackets that pivot in relation to each other. The two members may include the first jamb member 106 that fastens to the jamb, and the first door member 112 that fastens to the door.

In some embodiments, the first jamb member 106 may be configured to mount to the jamb. The jamb may include a frame on a bookcase, a doorjamb, and a cabinet frame. The first jamb member 106 includes a first jamb hinge aperture 108 for receiving the axial load arm 104 and enabling rotation of the first hinge assembly 102. The axial load arm 104, in the form of a bearing, provides enhanced structural support for the axial load and inhibits movement between the members. In this manner, periodic motion, excess spacing, play, vibrations, or abrasive deterioration in the first hinge assembly 102 during operation and while supporting the door may be dampened. Those skilled in the art will recognize that the thrust bearing is efficacious for supporting heavier axial loads and slow rotational movement, such as found in a bookcase. In one embodiment, the axial load arm 104 may support an axial load of at least three hundred pounds.

The axial load arm 104 may include a bearing, such as a ball thrust bearing to rotatably connect the different members. However in other embodiments, the bearing may include, without limitation, a spherical roller thrust bearing, a cylindrical roller thrust bearing, a tapered thrust bearing, and a needle thrust bearing. Those skilled in the art, in light of the present teachings, will recognize that the axial load is more efficiently supported on the axial load arm 104 in the form of a thrust bearing. In this embodiment, the axial load transfers to a bearing outer race. The axial load on the bearing outer race transfers to a spherical ball inside the bearing outer race. The axial force on the spherical ball transfers to a bearing inner race. This transfer of loads results in a more evenly distributed axial load on the hinge system 100. In one embodiment, the bearing may include a thrust bearing that supports at least three hundred pounds of load, including the case door and any items in the case. The axial load arm 104 may also include a smooth outer surface. The smooth surface enables pivoting of the first hinge assembly 102 and inhibiting abrasive wear on the axial load arm 104.

Figure 1B:
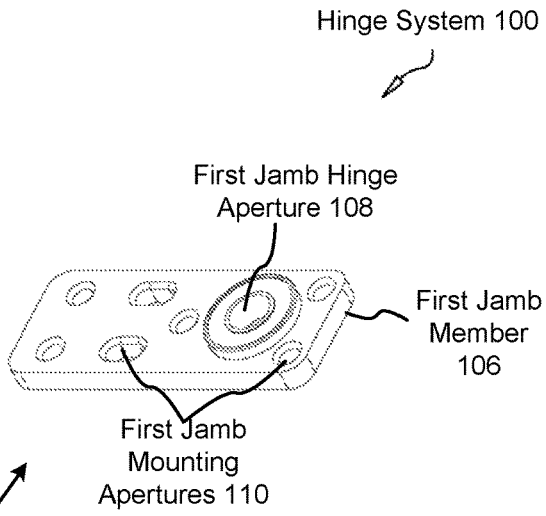

The first jamb member 106 further includes a plurality of first jamb mounting apertures 110 for adjustably mounting to the jamb. The plurality of first jamb mounting apertures 110 enable at least one fastener to pass through for securing the first jamb member 106 to the jamb. The at least one fastener may include, without limitation, threaded screws, bolts, and nails. The jamb mounting apertures 110 may include both circular, and non-circular cross sections. The non-circular cross section apertures enable fasteners in the members to be adjusted during mounting. The extra space provided by the non-circular apertures during mounting helps inhibit the periodic motions and facilitates installation. In one embodiment, the first jamb member 106 includes five circular jamb mounting apertures, and two non-circular, or slot shaped, jamb mounting apertures (FIGS. 1A and 1B).

In some embodiments, the first door member 112 may be configured to mount to the door. The door may include, without limitation, a bookcase door, a Murphy Door™, and an invisible door. The first door member 112 includes a first door hinge aperture 114 for receiving the axial load arm 104 and enabling rotation of the first hinge assembly 102. The axial load arm 104 may pass through the first door hinge aperture 114 and the first jamb hinge aperture 108, forming a connection that enables the first jamb member 106 and the first door member 112 to pivot in relation to each other. In some embodiments, the first jamb member 106 and the first door member 112 may be pressed together to firmly secure the axial load arm 104 therebetween. This pressing force further reduces periodic motion and extra space between the first jamb member 106 and the first door member 112.

Figure 1C:
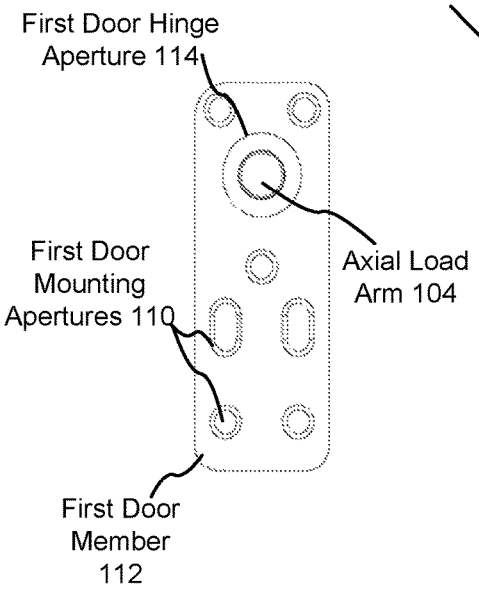
Figure 1D:
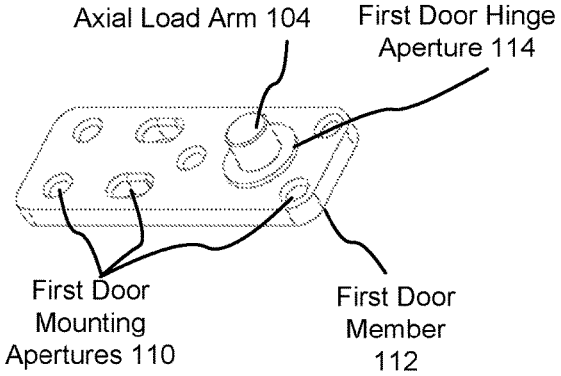

Similar to the first jamb member 106, the first door member 112 includes a plurality of first door mounting apertures 116 for adjustably mounting to the door. The plurality of first door mounting apertures 116 are positioned to align with the plurality of first jamb mounting apertures 110 (FIGS. 1C and 1D). The plurality of first door mounting apertures 116 enable the at least one fastener to pass through the plurality of first door mounting apertures 116 for securing the first door member 112 to the door. The first door mounting apertures 116 may include both circular, and non-circular cross sections. The non-circular cross section apertures enable fasteners in the members 106, 112 to be adjusted during mounting. The extra space provided by the non-circular apertures during mounting helps inhibit the periodic motions and facilitates installation. In one embodiment, the first jamb member 106 includes five circular jamb mounting apertures, and two non-circular, or slot shaped jamb mounting apertures.

Figure 1E:
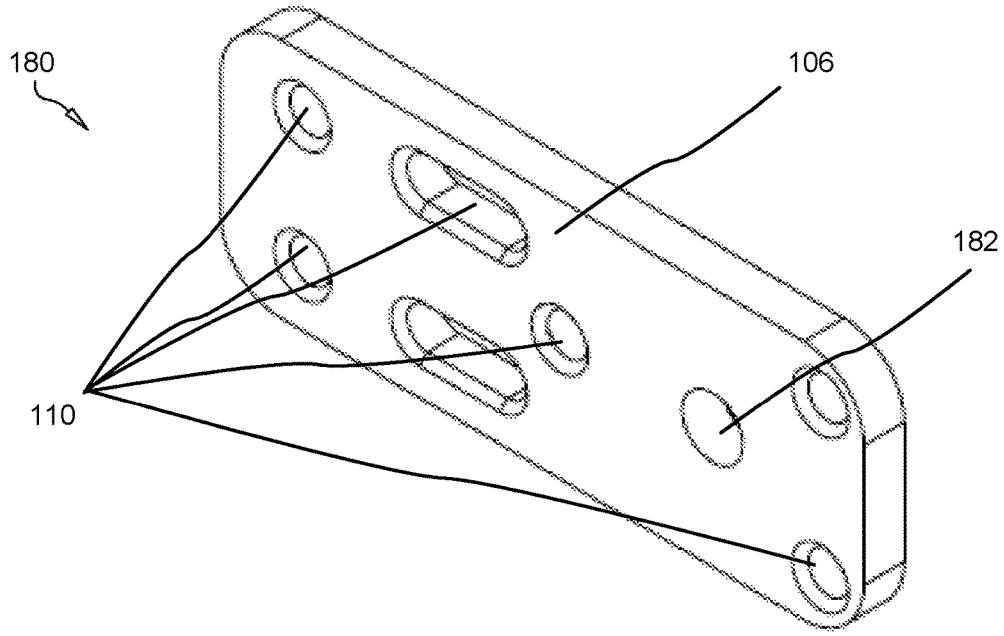
FIGS. 1E and 1F are various views illustrating a second embodiment of an exemplary first hinge assembly, where
Figure 1F:
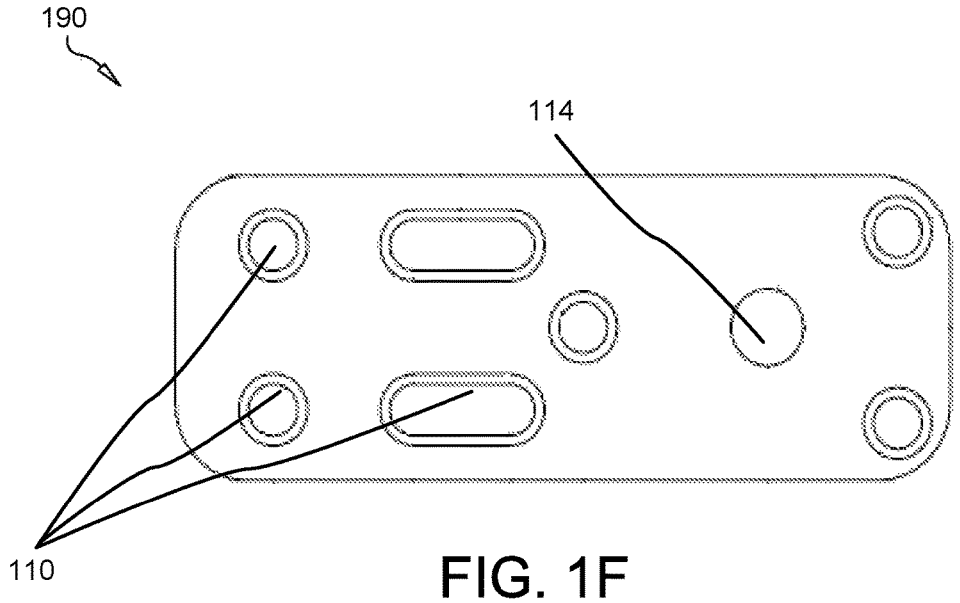

FIGS. 1E and 1F are various views illustrating a second embodiment of an exemplary first hinge assembly, where FIG. 1E is a top side view of an exemplary first hinge member 180 and FIG. 1F is a detailed top perspective view of the second embodiment of the exemplary first door member 190, in accordance with the present invention.

The jamb mounting apertures 110 are shown. Unlike the first embodiment 100, the hinge member 180 defines a first hinge member aperture 182 similar to the first jamb hinge aperture 108. The hinge member 180 defines an aperture 182, or passageway, through which a hinge pin (further described below) traverses.

Figure 2A:
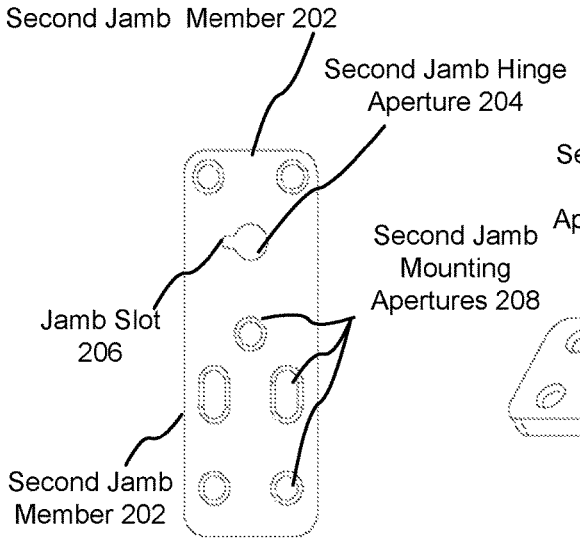
FIGS. 2A, 2B, 2C, and 2D are various views illustrating an exemplary second hinge assembly, where
Figure 2B:
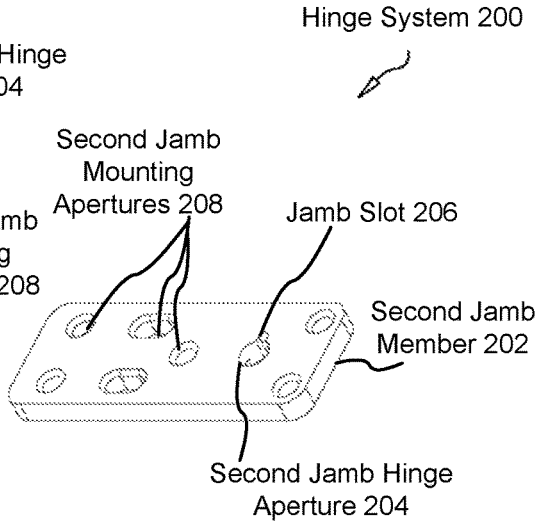

Turning now to FIGS. 2A and 2B, similar in most regards, except for the connecting arm and the height of elevation, a second hinge assembly 200 comprises two members, or brackets that pivot in relation to each other. The two members include the second jamb member 202 that fastens to the jamb, and the second door member 210 that fastens to the door. The lock arm 300 along with the second adjustable mounting apertures 208, 214 provide the substantial part of the novelty for reducing the play or periodic motion and abrasive wear between the second jamb member 202 and the second door member 210. In this manner, at least partial elimination of periodic motion, vibration, and excessive space between the second jamb member 202 and the second door member 210 may be realized. The tighter pivot that this invention offers may also minimize sagging by the door and potential maintenance problems.

The second jamb member 202 may be configured to mount to the jamb, often at a height beneath the first jamb member 106. However in other embodiments, the positions of the members 106, 202 may be reversed. The second jamb member 202 includes a second jamb hinge aperture 204 for receiving the lock arm 300 and enabling rotation of the second hinge assembly 200.

As referenced in FIGS. 2A and 2B, the second jamb hinge aperture 204 comprises a jamb slot 206 for regulating the lock arm 300 between a release position 306 and a lock position 304 in relation to the second hinge assembly 200. The lock arm 300 may include a smooth surfaced lock arm 300, such as a locking pin, to rotatably connect the different members 202, 210. The lock arm 300 does not use teeth or ridges to fasten the second jamb member 202 to the second door member 210, but rather, has a substantially smooth outer surface to pivot through the second jamb hinge aperture 204. The smooth surface may be less susceptible to abrasive wear during rotational operation. In one embodiment, the lock arm 300 comprises a locking pin.

The second jamb member 202 further includes a plurality of second jamb mounting apertures 208 for adjustably mounting to the jamb. The plurality of second jamb mounting apertures 208 enable the at least one fastener to pass through for securing the second jamb member 202 to the jamb. The plurality of second jamb mounting apertures 208 may include both circular, and non-circular cross sections. The non-circular cross section apertures enable fasteners in the second jamb member 202 to be adjusted during mounting. The extra space provided by the non-circular apertures during mounting helps inhibit the periodic motions and facilitates installation. In one embodiment, the second jamb member 202 includes five circular jamb mounting apertures, and two non-circular, or slot shaped jamb mounting apertures (FIGS. 2A and 2B).

Figure 2C:
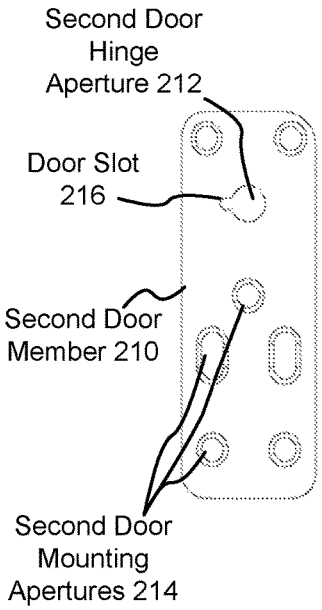
Figure 2D:
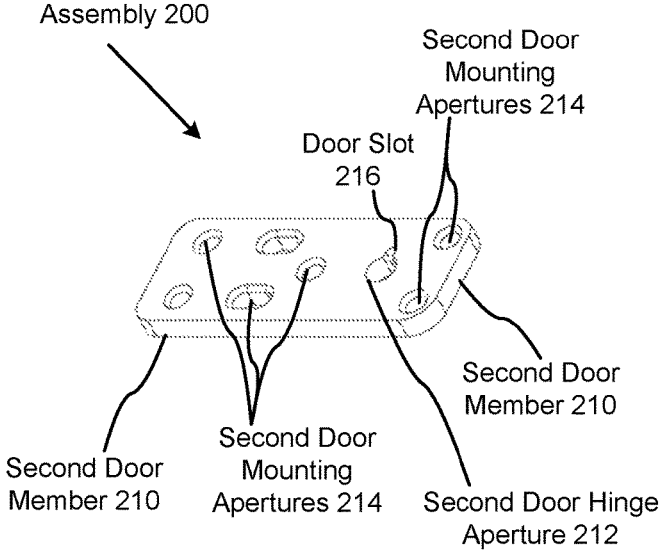

FIGS. 2C and 2D illustrate the second door member 210 that attaches to the door. The second door member 210 includes a second door hinge aperture 212 for receiving the lock arm 300 and enabling rotation of the second hinge assembly 200. The lock arm 300 passes through the second door hinge aperture 212 and the second jamb hinge aperture 204, forming a connection that enables the second jamb member 202 and the second door member 210 to pivot in relation to each other. The second door hinge aperture 212 comprises a door slot 216 that aligns with the jamb slot 206. A protruding portion 302 from the lock arm 300 rotates between a release position 306, in alignment with both slots; to a lock position 304, in misalignment with the jamb slot 206 and the door slot 216. In this manner, the second members 202, 210 lock and release from each other. The efficient manner of disengaging the second door member 210 from the second jamb member 202 by rotating the lock arm 300 to move to the release position 306 provides efficient and fast installation and replacement.

Similar to the second jamb member 202, the second door member 210 includes a plurality of second door mounting apertures 214 for adjustably mounting to the door. The plurality of second door mounting apertures 214 are positioned to align with the plurality of second jamb mounting apertures 208. The plurality of second door mounting apertures 214 enable the at least one fastener to pass through the plurality of second door mounting apertures 214 for securing the second door member 210 to the door. The plurality of second door mounting apertures 214 may include both circular, and non-circular cross sections. The non-circular cross section apertures enable fasteners in the members to be adjusted during mounting. The extra space provided by the non-circular apertures during mounting helps inhibit the periodic motions and facilitates installation. In one embodiment, the first jamb member 106 includes five circular jamb mounting apertures, and two non-circular, or slot shaped jamb mounting apertures (FIG. 2C).

Figure 2E:
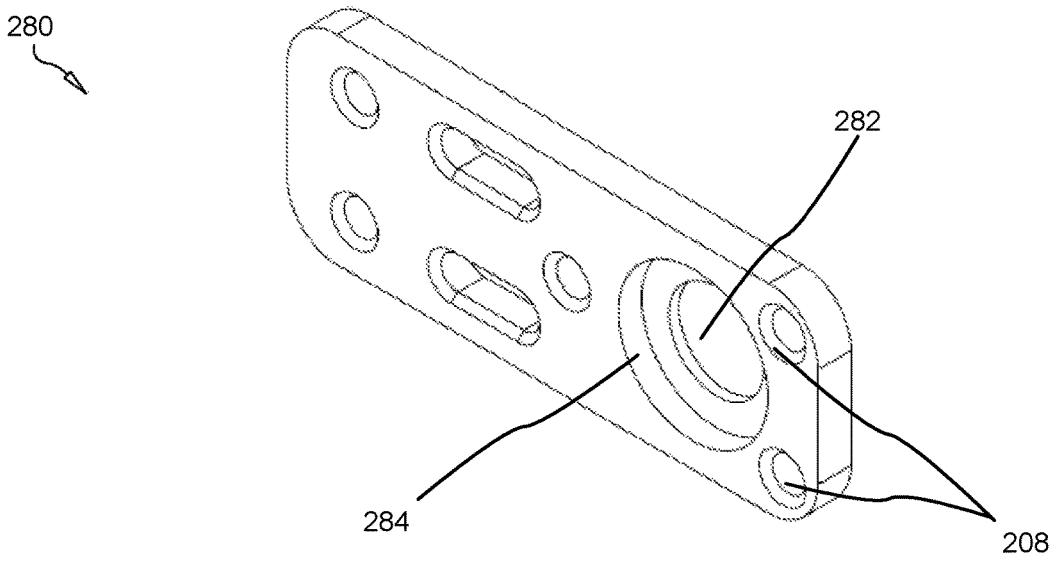
FIGS. 2E and 2F are various views illustrating a second embodiment of an exemplary second hinge assembly, where
Figure 2F:
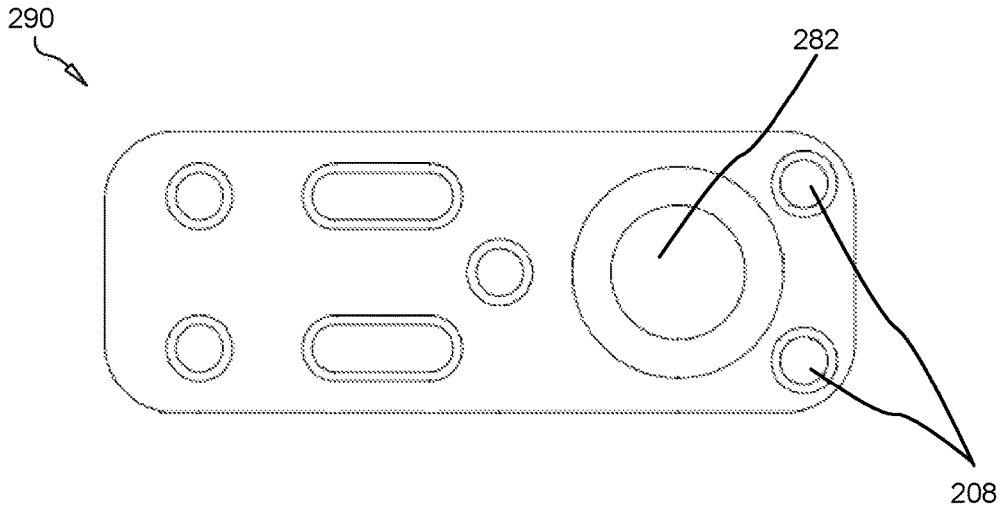

FIGS. 2E and 2F are various views illustrating a second embodiment of an exemplary second hinge assembly, where FIG. 2E is a top side view of the exemplary second hinge member 280 and FIG. 2F is a detailed top perspective view of the second embodiment of the exemplary second hinge member, in accordance with the present invention.

The second hinge member 280 defines a second hinge member aperture 282 through which a hinge pin traverses. The second hinge member aperture 282 is circumscribed by an annular recess 284 for receiving a corresponding protruding recess of a mating first hinge member 180.

Figures 3A, 3B, 3C:
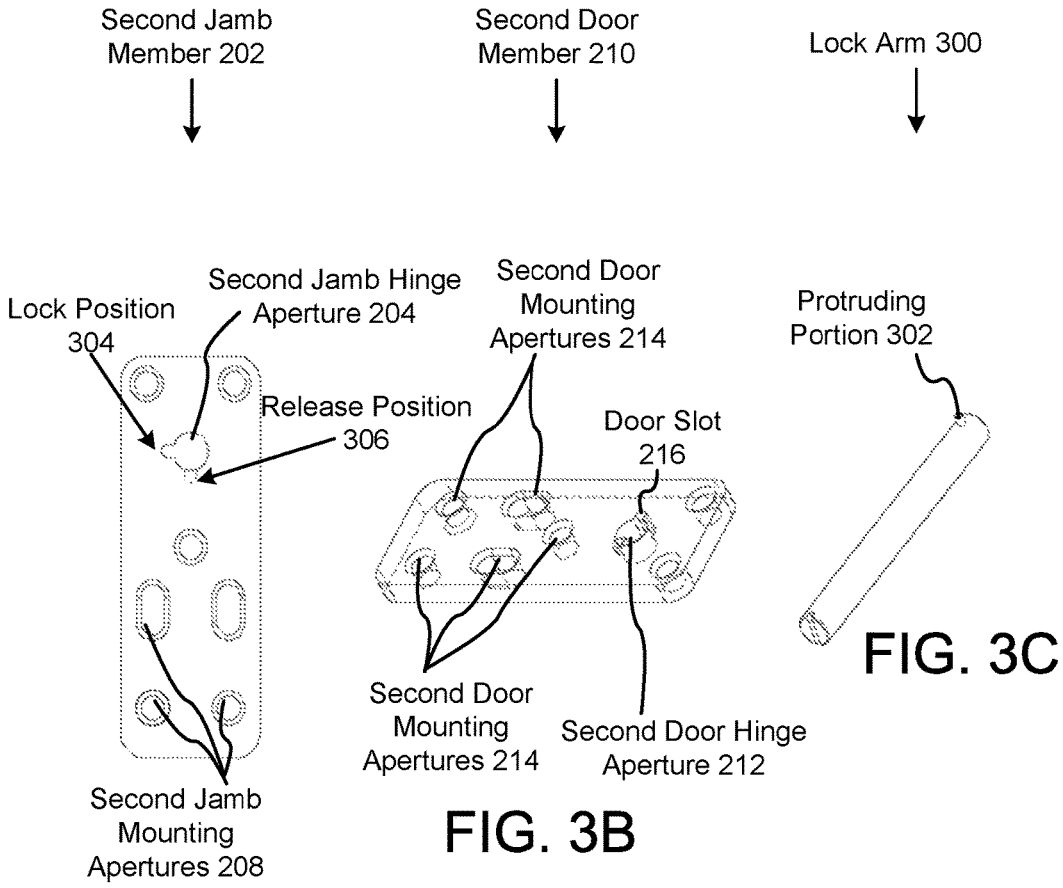
FIGS. 3A, 3B, and 3C are various views illustrating an exemplary lock arm engaging an exemplary second hinge assembly, where
Figure 4A:
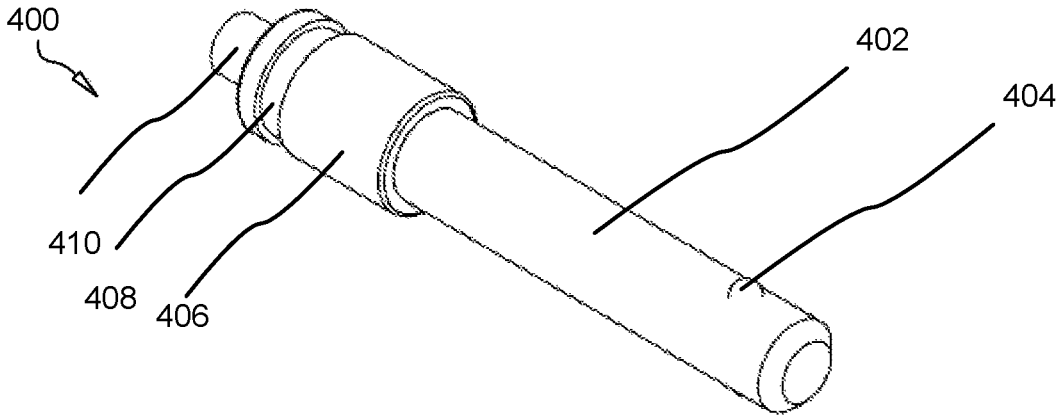
FIGS. 4A, 4B, 4C, and 4D illustrate various perspective views of an elongated releasable hinge pin with retractable latch pins.
Figure 4B:
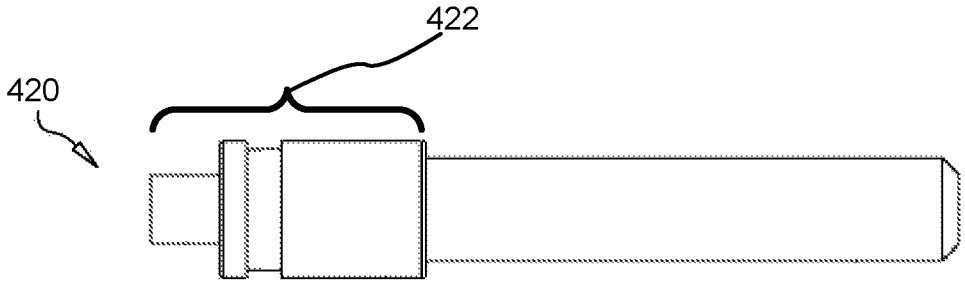
Figure 4C:
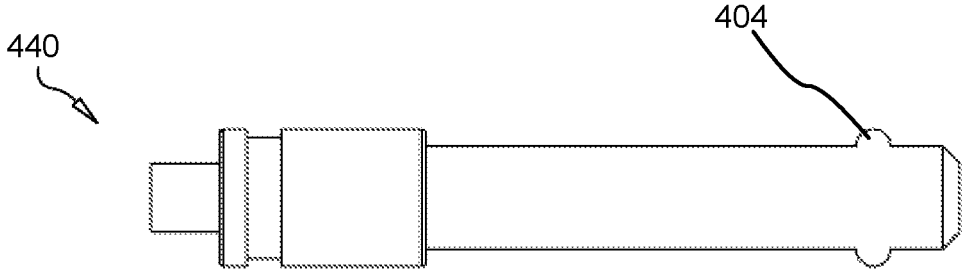
Figure 4D:
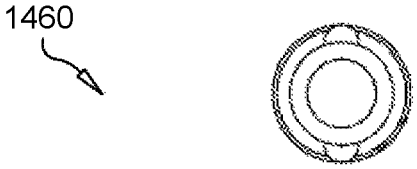
Figure 5A:
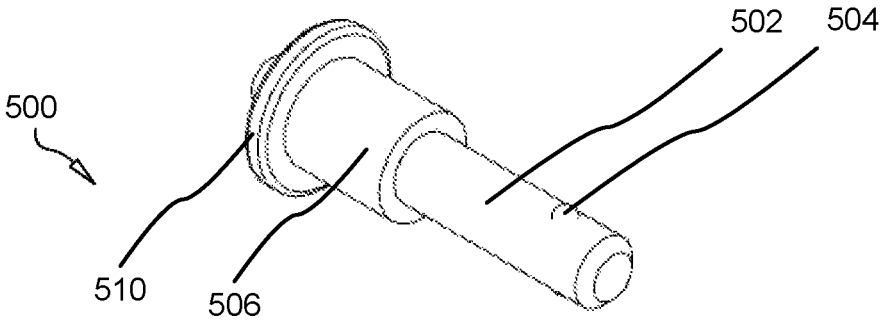
FIGS. 5A, 5B, 5C, and 5D illustrate various perspective views of a shortened releasable hinge pin with retractable latch pins.
Figure 5B:
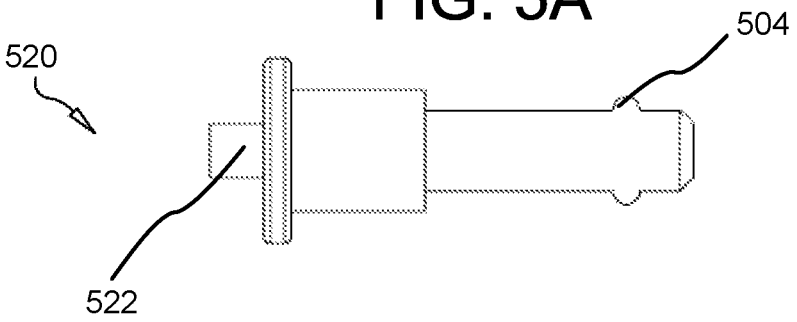
Figure 5C:
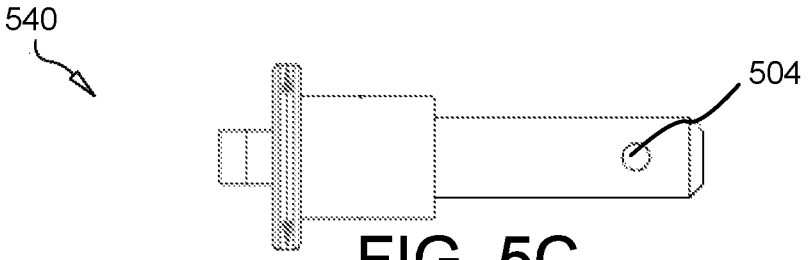
Figure 5D:
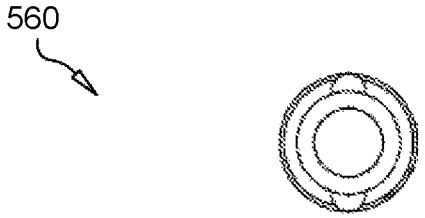

Turning now to FIGS. 3A, 3B, and 3C, the lock arm 300 may include a protruding portion 302, such as a rod, that extends from a terminal end. The protruding portion 302 is configured to align with and move in and out of the jamb slot 206 and the door slot 216 in the respective member 202, 210. The orientation of the protruding portion 302 in relation to the slots 206, 216 enables the second members 202, 210 to separate or securely join. In yet another aspect referenced in FIG. 3C, the lock arm 300 may have sufficient structural integrity to at least partially provide additional support for the axial load and inhibit movement between the second jamb member 202 and the second door member 210. In this manner, any periodic motion, excess spacing, play, vibrations, or abrasive deterioration between the second members 202, 210 during operation and while supporting the door may be reduced from both the first and second hinge assembly 102, 200.

In one embodiment referenced in FIG. 3A, the release position 306 comprises the protruding portion 302 in alignment with a longitudinal axis of the jamb slot 206 and the door slot 216. The protruding portion 302 may then be free to move through the second jamb hinge aperture 204 and the second door hinge aperture 212, wherein the second jamb member 202 and the second door member 210 separate in the release position 306. In another embodiment, the lock position 304 comprises the protruding portion 302 misaligned with the longitudinal axis of the jamb slot 206 and the door slot 216. The protruding portion 302 is then blocked from free movement by the second jamb member 202 or the second door member 210, wherein the second jamb member 202 and the second door member 210 securely fasten in the lock position 304.

FIGS. 4A, 4B, 4C, and 4D illustrate various perspective views of an elongated releasable hinge pin 400 with retractable latch pins. The releasable hinge pin 400 comprises a hollow cylindrical shaft 402, two retractable latch pins 404, a proximal sleeve 406 defining an axial recess 408, and a depressible button 410 extending upwardly from a proximal top end of the hinge pin 100.

The shaft 402 defines a hollow passageway. The pin 400 is adapted to retract latch pins 404 when a depressible button 410 is depressed. In this manner, a hinge assembly can be easily disassembled and reassembled quickly. The extended latch pins 404 prevent extraction of the pin 400 from a hinge assembly while retracted latch pins 404 permit extraction.

The proximal sleeve 406 is disposed on the proximal end of the pin 400.

FIGS. 5A, 5B, 5C, and 5D illustrate various perspective views of a shortened releasable hinge pin 500 with retractable latch pins. The hinge pin 500 comprises a shaft 402, retractable latch pins 504, a proximal sleeve 506, and annular rim 510.

The annular rim 510 comprises an uninterrupted annular ring circumscribing the sleeve 506 gripable by a polymeric implement for extracting the pin 500 from a hinge assembly.

Like the pin 400, the pin 500 is adapted to retract the latch pins 504 when the depressible button 522 is depressed using a polymeric implement.

Figure 6:
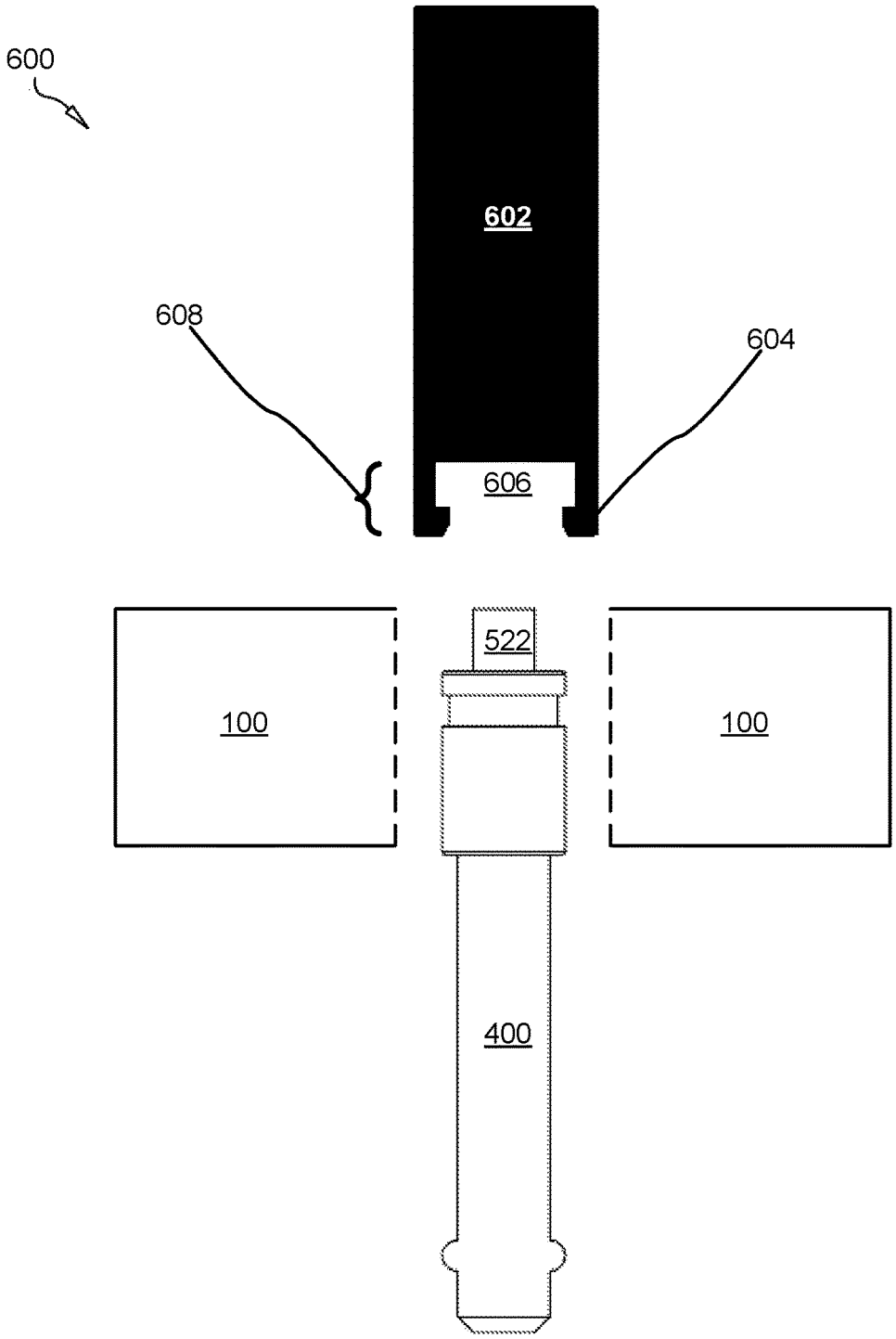
FIG. 6 illustrates a sectioned environmental perspective view of an elongated releasable hinge pin and extraction tool.

FIG. 6 illustrates a sectioned environmental perspective view of an elongated releasable hinge pin and extraction tool 600. The tool 600 comprises a cylindrical polymeric body 602 having an open bottom end 608. The open bottom end 608 is defined by an uninterrupted cylindrical sidewall 604 having a cantilevered interior rim for gripping a sleeve 406, 506 while depressing the button 410, 522.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A hinge for reducing a periodic motion while supporting an axial load, the hinge comprising:

a first hinge assembly configured to at least partially support an axial load, and rotatable to move a door between an open position and a closed position, the first hinge assembly comprising a first jamb member disposed to attach to one of a door and a jamb, the first jamb member defining a first jamb hinge aperture, the first jamb member further defining a plurality of first jamb mounting apertures configured to enable passage of at least one fastener for fastening the first hinge assembly to one of the jamb and the door, wherein at least one of the first jamb mounting apertures having a noncircular cross section for enabling adjustable mounting of the first hinge member, a second hinge assembly configured to cooperate along a common axis of a door with the first hinge assembly and having a common longitudinal axis so that the first and second hinge members are rotatable to move the door between the open position and the closed position, wherein the second hinge assembly comprises a second jamb member disposed to attach to one of a door and the jamb, the second hinge member defining a second jamb hinge aperture circumscribed by an annular recess, the second jamb hinge aperture comprising a jamb slot adapted to enable passage of a releasable hinge pin for fastening the second hinge member to the first hinge member, wherein first hinge assembly and second hinge assembly are adapted to enable passage of the releasable hinge pin, the releasable hinge pin comprising:

a depressible, spring-loaded button protruding upwardly from a proximal top end of the hinge pin, the depressible, spring-loaded button adapted to retract two latch pins protruding laterally from a cylindrical body of the hinge pin.

2. The hinge of claim 1, in which the door and the jamb are configured for a bookcase.

3. The hinge of claim 2, in which the axial load comprises a weight of the bookcase and at least one item in the bookcase.

4. The hinge of claim 1, in which the noncircular cross section enables a vertical adjustment during mounting.

5. A hinge for reducing a periodic motion while supporting an axial load, the hinge system comprising:

a first jamb member comprising a thrust bearing and defining a first jamb hinge aperture, the first jamb hinge adapted to enable passage of a releasable hinge pin, the first jamb hinge defining a plurality of mounting apertures having non circular cross sections;

a second door member defining a second jamb hinge aperture circumscribed by an annular recess and door slot, the second jamb hinge adapted to enable passage of the releasable hinge pin;

a releasable hinge pin, the releasable hinge pin traversing the first jamb member and the second door member comprising:

a depressible, spring-loaded button protruding upwardly from a proximal top end of the hinge pin, the depressible, spring-loaded button adapted to retract two latch pins into a cylindrical body of the hinge pin;

wherein the hinge is configured to at least partially support an axial load, and rotatable to move a door between an open position and a closed position.

6. A hinge for reducing a periodic motion while supporting an axial load, the hinge system consisting of:

a first jamb member defining a first jamb hinge aperture, the first jamb hinge adapted to enable passage of a releasable hinge pin, the first jamb hinge defining a plurality of mounting apertures;

a second jamb member defining a second jamb hinge aperture circumscribed by an annular recess and door slot, the second jamb hinge adapted to enable passage of a releasable hinge pin;

a releasable hinge pin, the releasable hinge pin comprising:

a depressible, spring-loaded button protruding upwardly from a proximal top end of the hinge pin, the depressible, spring-loaded button adapted to retract two latch pins into a cylindrical body of the hinge pin;

wherein the hinge is configured to at least partially support an axial load, and rotatable to move a door between an open position and a closed position.

* * * * *